US008111225B2

(12) United States Patent
Hayashi et al.

(10) Patent No.: US 8,111,225 B2
(45) Date of Patent: Feb. 7, 2012

(54) LIQUID CRYSTAL DISPLAY DEVICE HAVING A PLURALITY OF SUBFIELDS

(75) Inventors: Keiji Hayashi, Kawasaki (JP); Tetsuya Kobayashi, Kawasaki (JP); Ryo Tanaka, Yokohama (JP); Shinpei Nagatani, Kawasaki (JP); Kouichi Katagawa, Zama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/805,935

(22) Filed: Aug. 25, 2010

(65) Prior Publication Data

US 2010/0321416 A1 Dec. 23, 2010

Related U.S. Application Data

(62) Division of application No. 11/441,224, filed on May 26, 2006, now abandoned.

(30) Foreign Application Priority Data

May 27, 2005 (JP) ..... 2005-155751

(51) Int. Cl.
*G09G 3/36* (2006.01)

(52) U.S. Cl. ..... 345/89; 345/690

(58) Field of Classification Search ..... 345/690, 345/89

See application file for complete search history.

(56) References Cited

U.S. PATENT DOCUMENTS

| | | | |
|---|---|---|---|
| 6,456,266 | B1 | 9/2002 | Iba et al. |
| 6,809,717 | B2 | 10/2004 | Asao et al. |
| 6,894,669 | B2 | 5/2005 | Suzuki et al. |
| 6,977,636 | B2 | 12/2005 | Jinda et al. |
| 7,161,576 | B2 | 1/2007 | Kawabe et al. |
| 7,184,018 | B2 | 2/2007 | Makino et al. |
| 7,522,140 | B2 | 4/2009 | Jinda et al. |
| 2002/0008683 | A1 | 1/2002 | Makino et al. |
| 2002/0044115 | A1 | 4/2002 | Jinda et al. |
| 2003/0058229 | A1 | 3/2003 | Kawabe et al. |

(Continued)

FOREIGN PATENT DOCUMENTS

JP 2000-19486 1/2000

(Continued)

OTHER PUBLICATIONS

Japanese Office Action dated Dec. 21, 2010 for corresponding Application No. 2005-155751.

(Continued)

*Primary Examiner* — Chanh Nguyen

*Assistant Examiner* — Long Pham

(74) *Attorney, Agent, or Firm* — Harness, Dickey & Pierce, P.L.C.

(57) ABSTRACT

A liquid crystal display device including a liquid crystal panel provided with plural gate lines to select a pixel and plural data lines to supply pixel data and a data driver dividing a single frame into plural fields and converting frame data into field data to supply the field data to the data line is provided. When the frame data has a tone change, the data driver performs correction to data of an odd-number field of the frame in a same direction as an increase/decrease direction of the tone change of the frame data, and performs correction to data of an even-number field of the frame in an opposite direction to the increase/decrease direction of the tone change of the frame data.

1 Claim, 13 Drawing Sheets

U.S. PATENT DOCUMENTS

| | | | | |
|---|---|---|---|---|
| 2003/0080983 | A1 | 5/2003 | Someya et al. | |
| 2003/0156092 | A1* | 8/2003 | Suzuki et al. | 345/98 |
| 2004/0155847 | A1 | 8/2004 | Taoka et al. | |
| 2004/0196274 | A1 | 10/2004 | Song et al. | |
| 2004/0239612 | A1 | 12/2004 | Asao et al. | |
| 2005/0035939 | A1* | 2/2005 | Akiyama | 345/102 |
| 2005/0184944 | A1* | 8/2005 | Miyata et al. | 345/89 |
| 2006/0022922 | A1 | 2/2006 | Jinda et al. | |
| 2006/0256141 | A1 | 11/2006 | Maruyama et al. | |
| 2007/0085794 | A1 | 4/2007 | Kawabe et al. | |

FOREIGN PATENT DOCUMENTS

| | | |
|---|---|---|
| JP | 2000-338464 | 12/2000 |
| JP | 2001-343943 | 12/2001 |
| JP | 2002-116743 | 4/2002 |
| JP | 2003-36056 | 2/2003 |
| JP | 2003-241721 | 8/2003 |

OTHER PUBLICATIONS

Japanese Office Action dated Oct. 12, 2010 for corresponding Application No. 2005-155751.

* cited by examiner

LIQUID CRYSTAL DISPLAY DEVICE HAVING A PLURALITY OF SUBFIELDS

CROSS-REFERENCE TO RELATED APPLICATIONS

This U.S. nonprovisional application is a divisional of U.S. application Ser. No. 11/441,224, filed May 26, 2006 now abandoned, which claims priority under 35 U.S.C. §119 to Japanese Patent Application No. 2005-155751, filed on May 27, 2005, the entire contents of which are incorporated herein by reference.

BACKGROUND OF THE INVENTION

1. Field of the Invention

The present invention relates to a liquid crystal display device.

2. Description of the Related Art

In recent years, liquid crystal display devices are in use as a unit of a digital television set, however, they are devaluated due to responses inferior to those of CRTs in displaying moving images. As a main cause thereof, it is known that a displacement is caused during one frame between an image on the same screen continuously displayed and an eye movement. As methods to obtain a display of the same level as of CRT, there have been presented a method in which a black screen is inserted and a method in which the flashing cycle (or a repeating cycle of a light state and a dark state) of a back light is made to coincide with a display cycle. However, both the methods are forced to lower the display luminance of completely white, having not yet reached to a wide practical use.

Further, in Japanese Patent Application Laid-Open No. 2000-338464 (patent document 1), there is described that, in a display element displaying images of plural frames in a second, a single frame $F_0$ is displayed by being divided into at least two fields $F_1$, $F_2$, in which at least in a sub field 1F of the single field $F_1$, a desired image is displayed at a first luminance $T_x$ and, in a remaining single sub-field 2F, an image being practically the same as the image displayed at the first luminance is displayed at a second luminance $T_y$ being smaller than the first luminance and larger than 0 (zero).

As an art realizing a higher luminance and a moving-image display performance together, it is conceivable to perform halftone display by driving the panel at a double speed. However, in the liquid crystal display device adopting the art, there exist two problems as will be described below. First, an insufficient resolution in the halftone display. Second, a ghost image at a luminance change is not resolved especially between low-tones.

SUMMARY OF THE INVENTION

An object of the present invention is to prevent resolution insufficiency in halftone display, or to prevent a ghost image at a luminance change between low tones.

According to an aspect of the present invention, a liquid crystal display device including: a liquid crystal panel provided with plural gate lines to select a pixel and plural data lines to supply pixel data; and a data driver dividing a single frame into plural fields and converting frame data into field data to supply the field data to the data line is provided. When the frame data has a tone change, the data driver performs correction to data of an odd-number field of the frame in a same direction as an increase/decrease direction of the tone change of the frame data, and performs correction to data of an even-number field of the frame in an opposite direction to the increase/decrease direction of the tone change of the frame data.

DETAILED DESCRIPTION OF THE PREFERRED EMBODIMENTS

Figure 1:
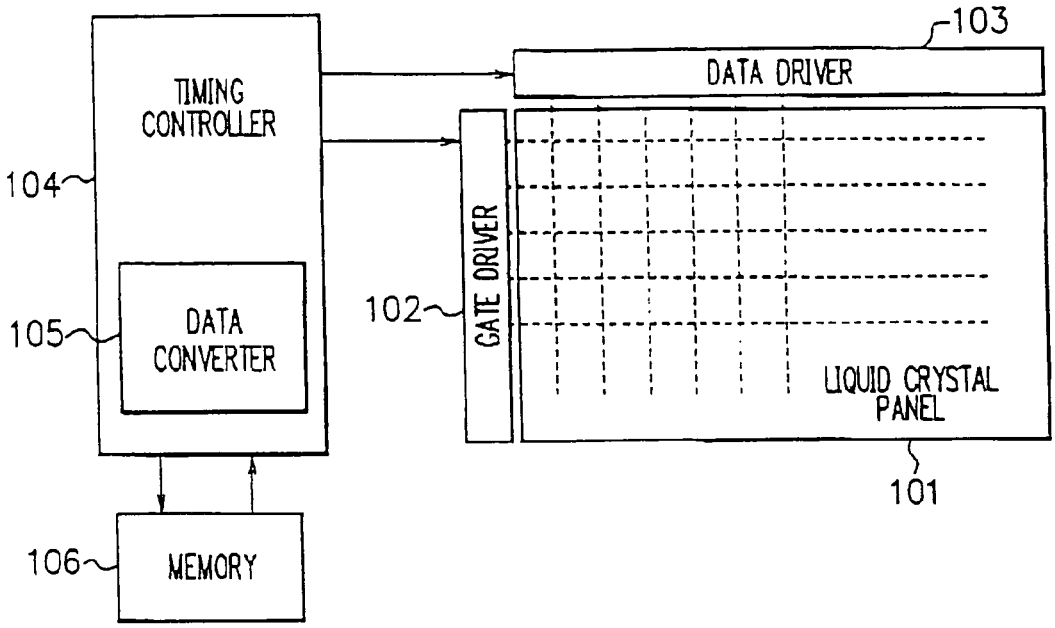
FIG. 1 is a view showing an example configuration of a liquid crystal display device according to first to fourth embodiments of the present invention.

FIG. 1 is a view showing an example configuration of a liquid crystal display device according to first to fourth embodiments of the present invention. A timing controller 104 includes a data converter 105 and is capable of writing/reading into/from a memory 106. The data converter 105 divides a single frame into plural fields in view of time to convert frame data into field data. The plural fields display respectively at a tone different from each other. A gate driver 102 supplies gate pulse voltage to a gate line (scanning line) in a liquid crystal panel 101 for each field thereof under the control of the timing controller 104. The gate line is a line to select a pixel. A data driver 103 supplies data voltage a data line (signal line) in the liquid crystal panel 101 for each field thereof under the control of the timing controller 104. The data line is a line to supply pixel data. The liquid crystal panel 101 includes an array substrate in which plural gate lines cross over plural data lines and active elements (TFTs: thin-film transistors) are provided at their crossover points, and an opposite substrate having at least ITO formed. The array substrate and the opposite substrate sandwich a liquid crystal layer therebetween. The above described TFT is arranged for each pixel. The TFT is, partly or wholly, formed by polysilicon. Also, the TFT is connected to the gate line and the data line via its gate and drain, respectively. When the gate line is supplied with gate pulse, the corresponding TFT turns ON, allowing the pixel of the TFT to be selected. In the pixel of the selected TFT, the alignment direction of liquid crystal molecules are determined in accordance with the data voltage supplied to the data line whereby the amount of transmitted light is determined, allowing the tone value of the pixel to be controlled.

Figure 14:
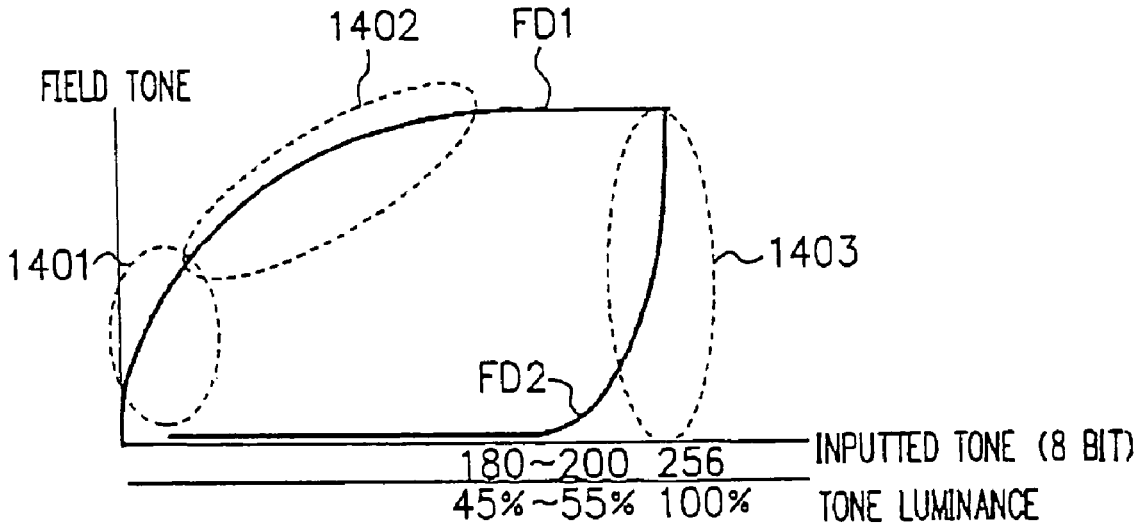
FIG. 14 is a view showing an example where a single frame is divided into two fields.

FIG. 14 is a view showing an example in which a single frame is divided into two fields. The horizontal axis indicates tones of the inputted frame data and the vertical axis indicates tones of a first field FD1 and a second field FD2. The first field FD1 is a first field and the second field FD2 is a last field.

As a data voltage, on a lower tone side, a data voltage V1 is applied to the first field FD1 and a data voltage Vd of black (lowest tone value) is applied to the second field FD2. Further, on a higher tone side, a data voltage Vw of white (highest tone value) is applied to the first field FD1 and a data voltage V3 is applied to the second field FD2. Respective voltages are selected so that the respective luminance originally aimed by the respective frames can be achieved on the basis of time quadrature of the data voltages V1 and Vb at the lower tone and the data voltages Vw and V3 at the higher tone.

A tone in which the voltage of the first field FD1 changes from V1 to Vw is a tone requiring 255 tone=Vw as V1 to achieve the frame luminance, being around 200 tone as an example. For instance, it is set so that a sum of the tone of the first field FD1 and the second field FD2–luminance characteristics meets $\gamma=2.4$.

A first object of such a tone setting is to improve response speed. The response characteristic of liquid crystal of vertical alignment (VA) type is known for its worse response when changing from a halftone to a halftone. In order to improve the response characteristic, there are two approaches as will be described below. (1) an approach that applies a voltage of a tone close to black in advance by which the liquid crystal molecules are given a pretilt angle, so that the response characteristic to a next tone is improved. (2) an approach that increases the voltage value of the tone to be achieved in that the response characteristic is better as the achieved tone becomes higher.

The later approach corresponds to a principle of overdrive. The voltage except the black voltage according to the former approach is because there is sometimes a case where the response speed is faster when an appropriate halftone is applied than when the black voltage is applied in advance.

The tone selection in the present embodiment has effects of a response speed improvement by enabling to apply a higher voltage to the first field FD1 than the conventional tone voltage on the lower tone side, and of a response characteristic improvement for the first field FD1 of the next frame by fixing the voltage applied to the second field FD2 to the black voltage on the lower tone side. Further, by fixing the voltage applied to the first field FD1 on the higher tone side to the white voltage, an effect of improving the response characteristic from the second field FD2 of the previous frame can be obtained.

A second object is to improve a moving-image characteristic. By applying the black voltage to the second field FD2 on the lower tone side, it is limited only to the first field FD1 that contributes as luminance when the liquid crystals have completely responded. This degrades the moving-image characteristic, in which an impulse-type display is realized from a hold-type display.

A third object is to improve a viewing-angle characteristic. In order to improve the viewing angle characteristic of tones, it is required to keep plural tone characteristics, namely plural luminance characteristics, in the pixel or for a time period, and this tone selection method is exactly the one that performs that for each field of the frames. In other words, a halftone driving effect can be obtained by a double-speed driving.

In the present embodiment, the halftone driving at an n-times speed can be performed. The halftone driving at the n-times speed is a driving that achieves the aimed luminance on a time-average basis by performing plural tone displays, which are different in each field of the plural fields, by a unit of pixel.

Also, in this improvement on the viewing angle characteristic of tones, it is known that a larger difference between two tones, namely luminance characteristics, obtains a larger effect. Accordingly, the second field FD2 is fixed at the black voltage Vb on the lower tone side, and the first field FD1 is fixed at the white voltage Vw on the higher tone side.

However, in order to obtain desired improvement effects in the moving-image characteristic and in the viewing angle characteristic of tones by this data voltage application, the response characteristic of the second field FD2 to black becomes important. In the first field FD1, the response characteristic is not regarded as a major problem backed by the application of overdrive (OD), however, when the black voltage is applied to the second field FD2, the response characteristic of liquid crystals to black becomes important since it is impossible to apply a voltage lower than the black voltage thereto. When the liquid crystals having a slower response speed are used here, the luminance cannot fall to black completely, so that the improvement effect in view of the moving-image characteristic degrades.

In other words, in the case of the liquid crystals having a slower response speed, it is required to use the overdrive (OD) for the second field FD2 as well. In this case, the voltage set in the second field FD2 at the lower tone is preferably the voltage of around 4 to 16 tone. When the voltage higher than the above is applied, the effect as an impulse-type display degrades and also the improvement effect in the viewing angle characteristic of tones degrades.

Further, when the response of the first field FD1 to the white voltage is slow, the overdrive (OD) is applicable by intentionally lower the white voltage beforehand. As methods to lower, a method of lowering the white voltage and a method of using a driver that can apply higher voltage while maintaining the white voltage can be cited.

In the former case, the luminance lowers as well, in which the voltage cannot be lowered extremely, and that when a higher voltage is applied when the white voltage has lowered, an overshoot of a response waveform arises to affect adversely to the moving-image characteristic. Accordingly, as an example target to lower, a voltage of a tone of approximately 240 is appropriate from a practical usage viewpoint.

It is possible to use overdrive when responding from black to white as well as from white to black by assigning the white voltage to the black voltage within the voltage range excluding the maximum and minimum voltages without using the applicable maximum or minimum voltage as the white voltage or the black voltage.

As described above, in the last field of the plural fields, a first constant voltage (black (smallest tone value) voltage or a voltage near the black voltage) is applied to the data line when the frame data is the smallest tone value to a first tone value. Further, in the first field of the plural fields, a second constant voltage (white (highest tone value) voltage or a voltage near the white voltage), which is higher than the first constant voltage, is applied to the data line when the frame data is a second tone value to the highest tone value.

The first problem is resolution insufficiency in the halftone display. As shown in FIG. 14, the first problem is a phenomenon caused because a characteristic (γ characteristic) between a tone of an input signal and a displayed luminance is based on a power function, in which the luminance at a mean value of the tone is largely shifted from a half (½) of white luminance. In a low tone region 1401 and a high tone region 1403, the field tone is excessive as compared to the displayed tone. In a halftone region 1402, the field tone is insufficient as compared to the displayed tone, causing tone collapse.

The above-described problems can be solved with any of approaches described below. A first approach is an approach that adjusts the tone, namely luminance, characteristic at a stage of being inputted into the liquid crystal panel, which will be described later in a first embodiment. A second approach is an approach that reduces the time of the field performing a light display among the fields displaying different tones by time-dividing the frame, which will be described later in a second embodiment.

The second problem is that the ghost image in the luminance change is not yet resolved especially between the low tones (the response compensation method at the time of the displayed tone change is not unspecified). The second problem can be solved by matching the form of a luminance—time waveform in the frame (a portion becoming a boundary between the moving images) just after the tone change with the form of a luminance—time waveform after the tone change. The approach will be described later in third and forth embodiments.

First Embodiment

As a first embodiment according to the present invention, a case where a single frame cycle is divided into two fields will be described. A drive circuit includes the memory 106 and the data converter 105 to correct the data voltage as shown in FIG. 1. The data converter 105 compares the data of the previous frame with the data of the current frame, reads out a correction value in a data conversion table in the memory 106, and adds it to the data of the field of the current frame to obtain a compensated tone data. The compensated tone data is designed to be applied to a pixel through the timing controller 104 and the data driver 103. Further, this conversion is performed to the data of the two fields in the single frame.

Figure 2:
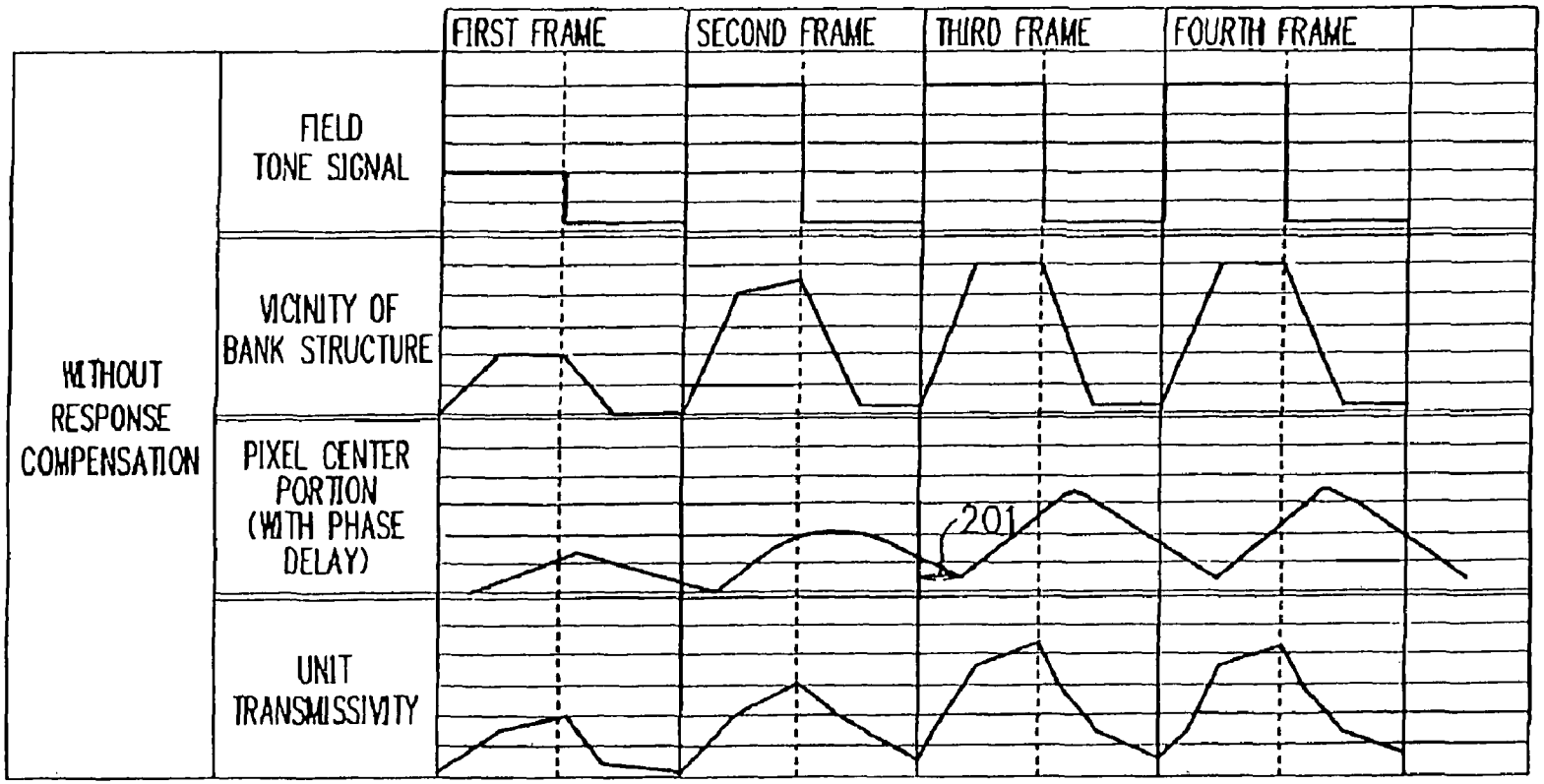
FIG. 2 is a view showing a field tone signal, a transmissivity in the vicinity of a bank structure, a transmissivity at a center portion of a pixel, and a transmissivity of a liquid crystal unit in the case where no response compensation is performed.

When it is driven at a frame frequency of approximately 60 Hz, in the liquid crystal panel of VA type of which response time (time from 10% to 90% of the achieved luminance) is approximately 12 ms, the responses from black to halftone and from white to halftone have a response characteristic as shown in FIG. 2 as a result of the combination of the elements.

FIG. 2 is a view showing a field tone signal, a transmissivity (luminance) in the vicinity of a bank structure, a transmissivity at a center portion of a pixel, and a transmissivity of a liquid crystal unit in the case where no response compensation is performed. At the center portion of the pixel, a delay by a phase 201 exists. In the vicinity of the bank in the pixel, the response is made at a time constant of 5 ms or below for the voltage change in each field, however, the response time constant delays as far it is away from the bank structure. In addition, the phase delay also arises with respect to the voltage change caused by repeating light and dark. As a result, in the response from black to halftone, the luminance change as shown in FIG. 2 can be seen.

Figure 3:
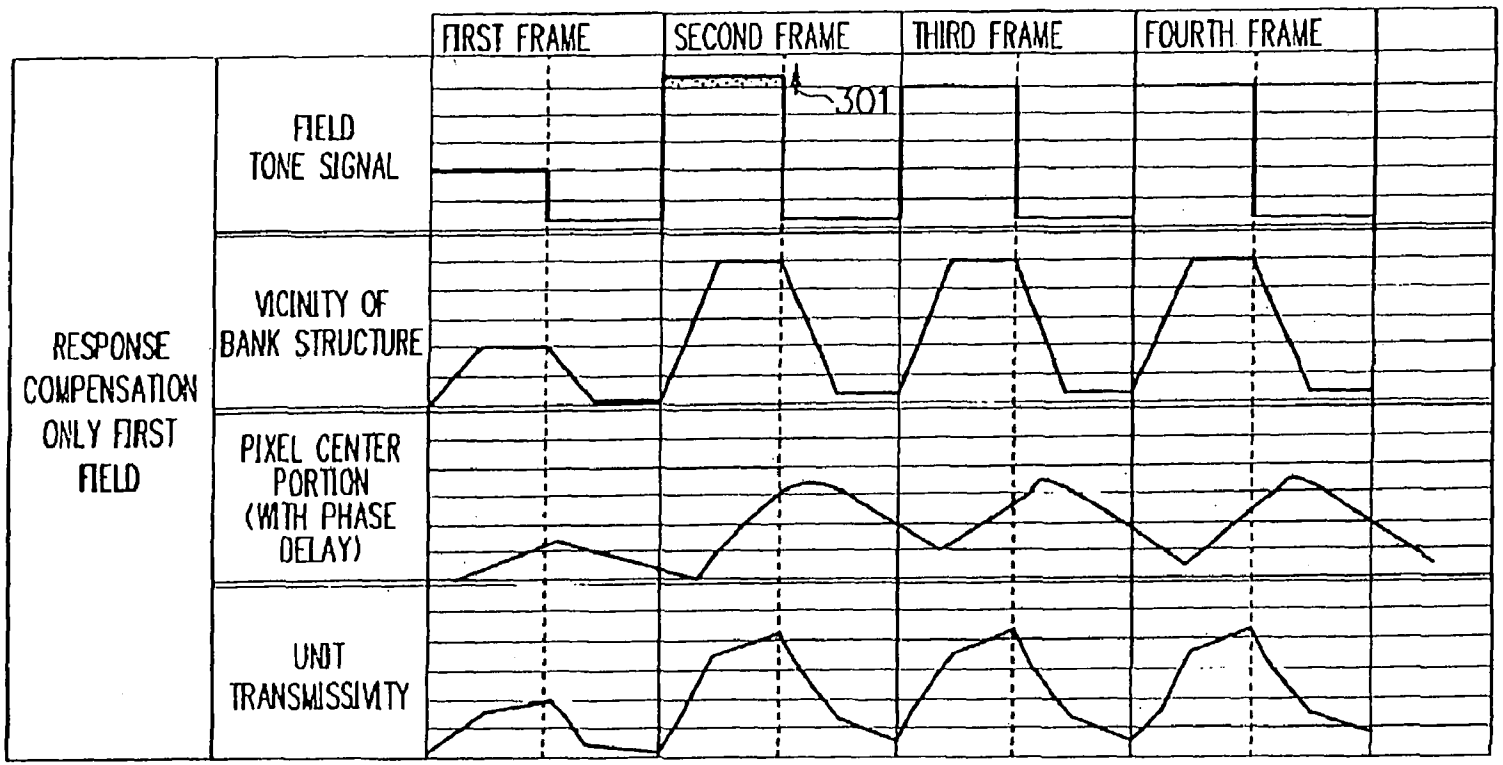
FIG. 3 is a view showing the field tone signal, the transmissivity in the vicinity of the bank structure, the transmissivity at the center portion of the pixel, and the transmissivity of the liquid crystal unit in the case where only the first field FD1 is compensated in response.

FIG. 3 is a view showing the field tone signal, the transmissivity in the vicinity of the bank structure, the transmissivity at the center portion of the pixel and the transmissivity of the liquid crystal unit in the case where only the first field FD1 is compensated in response. The field tone is made to change with a compensation value 301 so that the luminance of an end of the first field FD1 is made to be the same as of an end after the tone change (after stabilized) from the moment when the input tone signal changes. This compensation value 301 is the same numerical reference as of the input signal change, of which absolute value is approximately a third (⅓) or below as compared to the tone of completely white. However, only with this compensation, the luminance of the second field FD2 tends to increase under the influence of such an element of the above-described response that has the phase delay.

Figure 4:
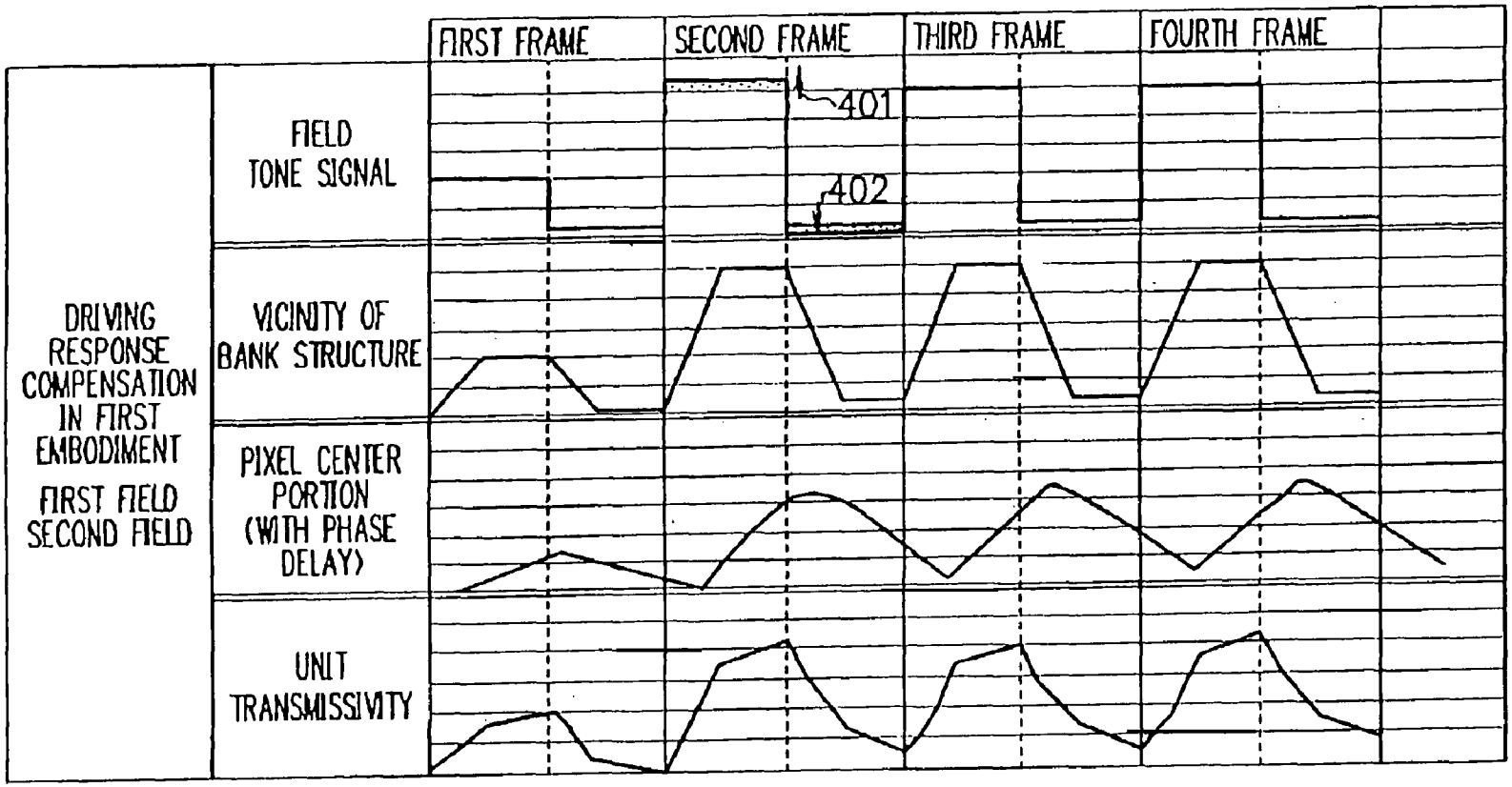
FIG. 4 is a view showing the field tone signal, the transmissivity in the vicinity of the bank structure, the transmissivity at the center portion of the pixel, and the transmissivity of the liquid crystal unit in the case where the first field FD1 and the second field FD2 are compensated in response.

FIG. 4 is a view showing the field tone signal, the transmissivity in the vicinity of the bank structure, the transmissivity at the center portion of the pixel and the transmissivity of the liquid crystal unit in the case where the first field FD1 and the second field FD2 are compensated in response. In addition to the above-described compensation value 301, the second field FD2 is reduced by a compensation value 402 being approximately a tenth (1/10) of an effective voltage of the tone of completely white. Therefore, in the second field (field on the lower luminance side) FD2, a larger effective voltage is set with respect to the black voltage (by the voltage for several tones). With this compensation value 402, the luminance increase in the second field FD2 in FIG. 3 can be prevented.

As described above, when a frame data has a tone change, the correction is made with the compensation value 301 to the data of the first field FD1 of the frame in the same direction as the increase/decrease direction of the tone change of the frame data, and the correction is made with the compensation value 402 to the data of the second field FD2 of the frame in the opposite direction to the increase/decrease direction of the tone change of the frame data.

Furthermore, in the above-described setting, a third field tends to cause luminance insufficiency; the addition within the range of 10 tone at maximum or below is therefore made to the field tone. When the frame tone (input) changes from light to dark, the tone correction for the above-described response compensation adopts opposite numerical references for the compensation value.

Second Embodiment

Figure 6A:
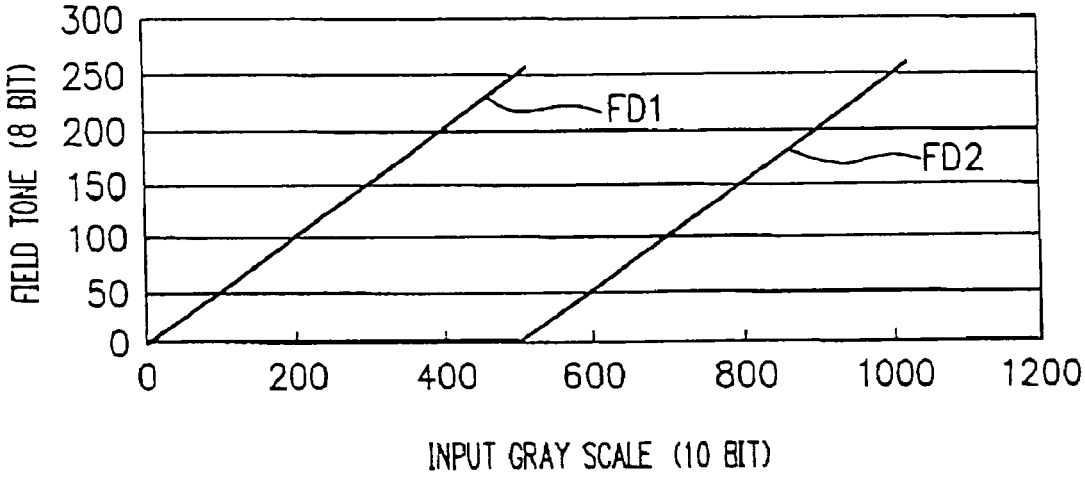
FIG. 6A is a view showing tones of the first field FD1 and the second field FD2 according to the second embodiment of the present invention and FIG. 6B is an enlarged view of a low-tone region of the FIG. 6A.
Figure 6B:
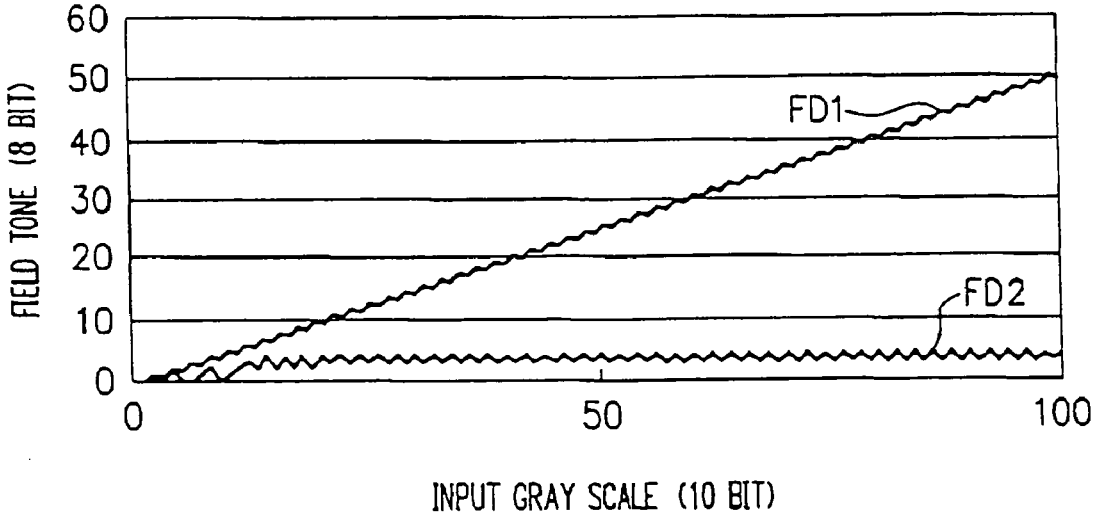

FIG. 6A is a view showing tones of the first field FD1 and the second field FD2 according to a second embodiment of the present invention and FIG. 6B is an enlarged view of a low-tone region of FIG. 6A. The first field FD1 and second field FD2 have a function of displaying gray at an accuracy of 8-bit tone, respectively, realizing a gray display of an accuracy of 10-bit tone in combination.

Figure 5:
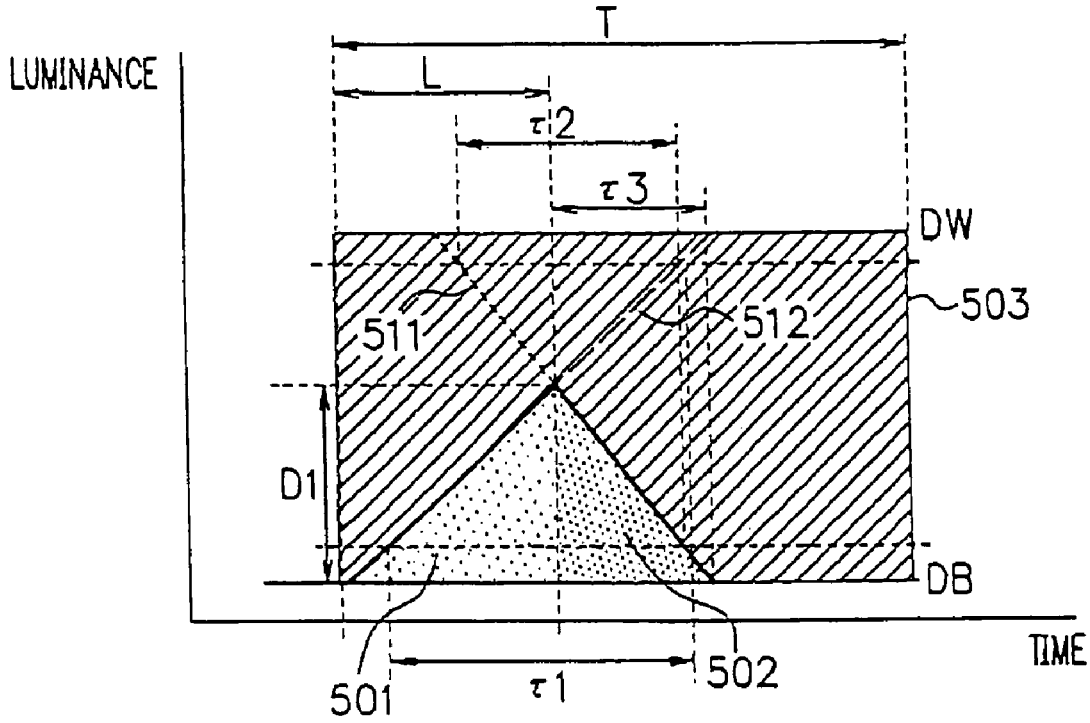
FIG. 5 is a view to explain a time proportion of divided fields according to the second embodiment of the present invention.

FIG. 5 is a view to explain how to determine a time proportion of the fields according to the present embodiment. The horizontal axis indicates time and the vertical axis indicates luminance. T indicates a frame cycle. DB indicates the luminance level of completely black and DW indicates the luminance level of completely white. A reference number 511 indicates a response curve from completely white to completely black and a reference number 512 indicates a response curve from completely black to completely white. A reference number 501 indicates a light amount of the first field FD1, a reference number 502 indicates a light amount of the second field FD2, and a hatching portion denoted by a reference number 503 indicates a light amount of completely white (steady-state). A time T3 is represented by $\tau 2/T\tau \times L$. A luminance level D1 is represented by $L/1.25\tau 1$.

For the liquid crystal panel in which the response time of the response curve 512 from completely black to completely white is 8 ms and the response time of the response curve 511 from completely white to completely black is 6 ms, the division proportion to divide a single frame into two fields is defined as one to two (1:2). Of the plural fields divided, the time of the first field FD1 on the higher luminance side is shorter than the time of the other field FD2.

When the single frame is divided into two fields and when a frame time is defined as T, the time of the first field FD1 on the higher luminance side is defined as L, and a response time from 10% to 90% of the finally achieved luminance when a change is made from a black display to a white display is defined as (2, then a field time proportion is set to meet an inequality shown below:

$$0.15\times T<L^2/(2\times\tau 1\times 1.25)+\tau 2/(2\times\tau 1)\times L<0.25\times T \quad (1)$$

What the inequality (1) means will be described with reference to FIG. 5. In the drawing, a case where the frame tone is expressed by approximating the light amounts, which are integrated with respect to time, to triangles as shown in the drawing by assuming the first field FD1 as the tone of completely white and the second field FD2 as the tone of completely black, since response times $\tau 1$ and $\tau 2$ of the liquid crystal panel are substantially at the same level as compared to the frame cycle T, is shown. The light amount 501 emitted during the first field FD1 is represented by the following formula.

$$I0\times L^2/(1.25\tau 1)/2$$

The light amount of the second field FD2 is represented by the following formula.

$$I0\times L\times\tau 2/(2\times\tau 1)$$

When the combination of this field tones (255 tone/0 (zero) tone) corresponds to the halftone (128 tone) in the frame tone (input), it is possible to say that the combination of the field tones is assigned most effectively.

However, only with this art, it is possible only to set a 9-bit gray tone at most. Therefore, the second field FD2 is defined as not black but 4 tone (8-bit expression) at maximum. By changing a tone of the second field FD2 within the range from 0 (zero) tone to 4 tone, the rising speed of the luminance in the first field FD1 shows a subtle change. As a result, the fineness in the tone expression can be improved. The respective field tones on the basis of 10-bit expression are shown in FIGS. 6A and 6B.

When the frame tone data (input into the liquid crystal display device) is 5 tone or more and approximately 128 tone or below on the basis of 8-bit tone expression, the tone of the second field FD2 on the lower luminance side can adopt the value of 2 tone to 5 tone on the basis of the 8-bit tone expression as the maximum value, and when the frame tone data (input into the liquid crystal display device) is approximately 128 tone or more on the basis of the 8-bit tone expression, the tone of the second field FD2 on the lower luminance side can adopt the value of 250 tone to 253 tone on the basis of the 8-bit tone expression as the minimum value.

Third Embodiment

A third embodiment according to the present invention has a function in which the frame tone data of the previous frame stored in the memory 106 is compared with the tone data of the current frame and when there is a difference between them, the field tone change is performed only to the first field.

Figure 9A:
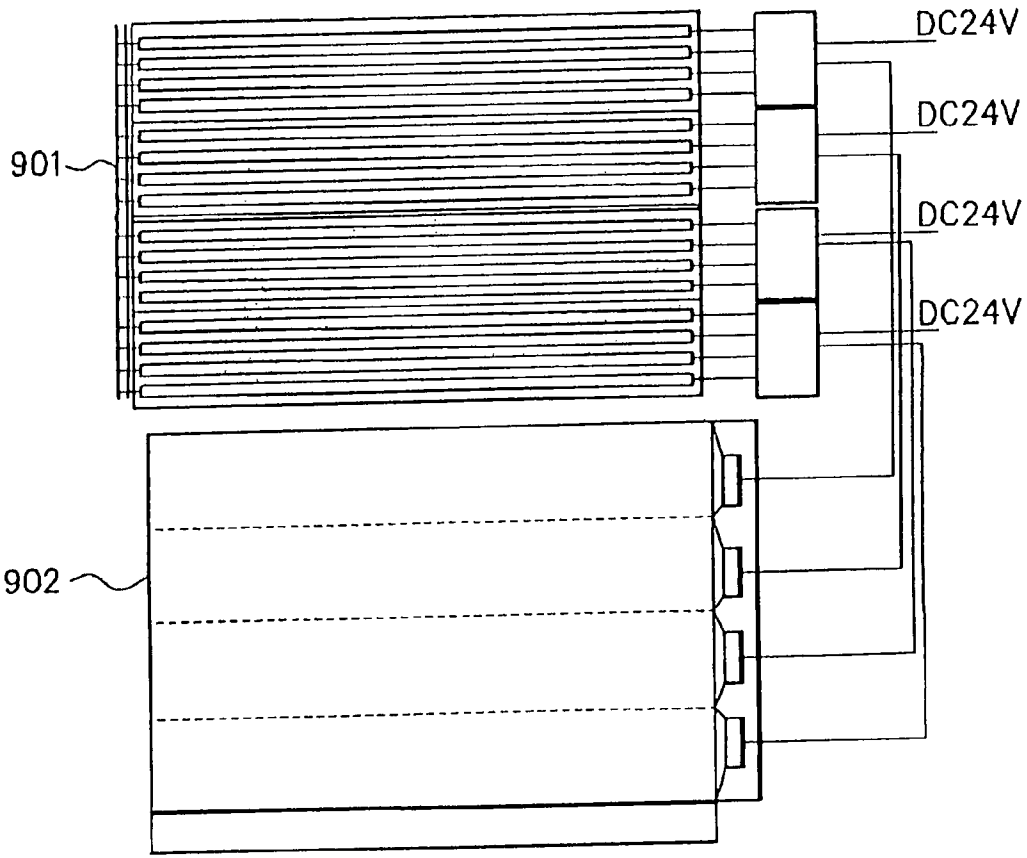
FIG. 9A is a view showing a connection example of the back light and a liquid crystal panel.
Figure 9B:
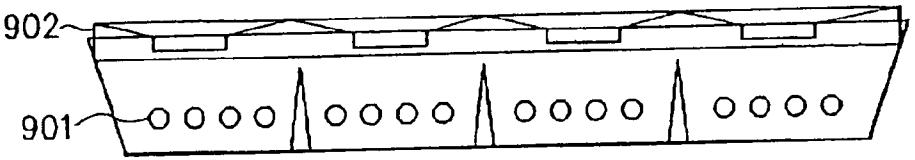
FIG. 9B is a sectional view of the back light and the liquid crystal panel.

FIG. 9A is a view showing a connection example of a back light 901 and a liquid crystal panel 902, and FIG. 9B is a sectional view of the back light 901 and the liquid crystal panel 902. The back light 901 emits light to the liquid crystal panel 902. The liquid crystal panel 902 controls transmissivity of the light of the back light 901 to carry out the tone expression.

Figure 7:
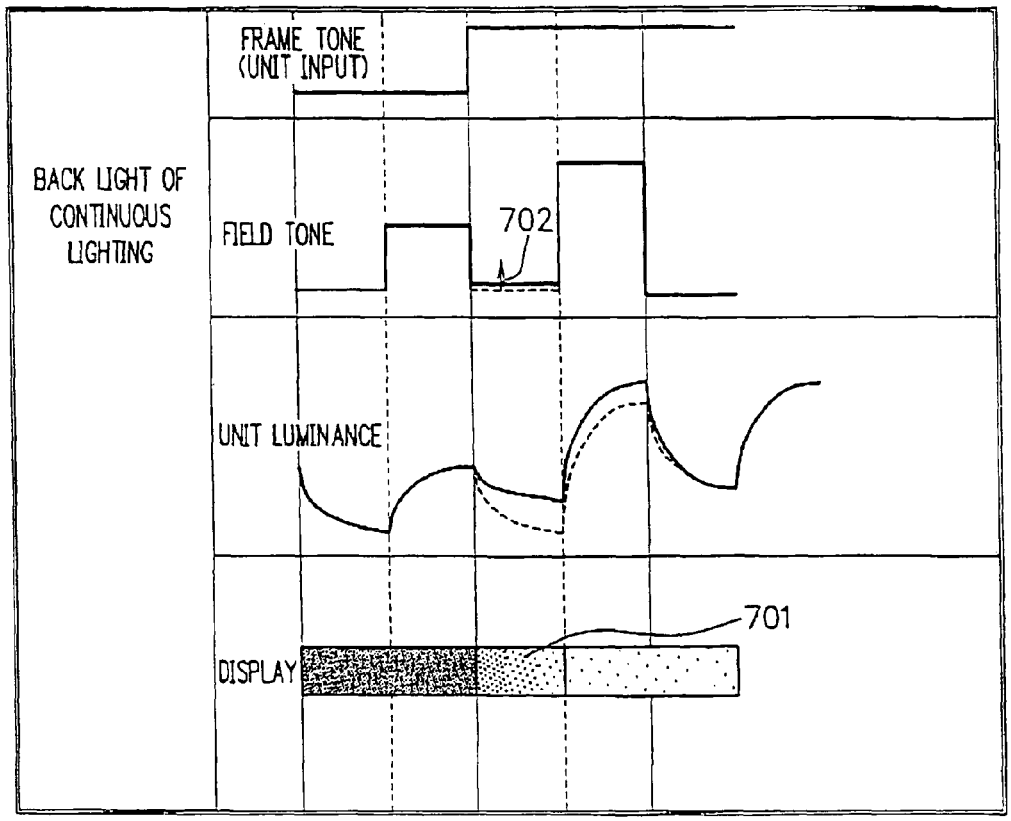
FIG. 7 is a view showing frame tone (input into a liquid crystal unit), field tone, liquid crystal unit luminance and display in the case where a back light is lighted continuously.
Figure 10:
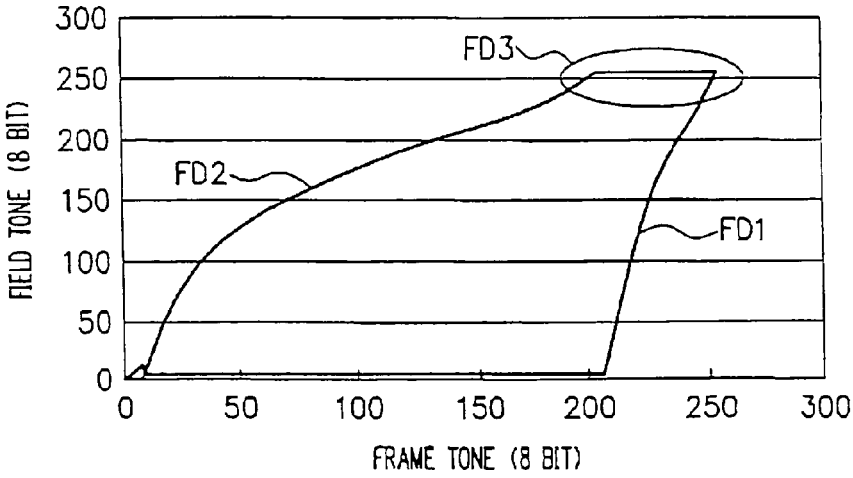
FIG. 10 is a view showing a relation between the frame tone and the field tone.

FIG. 7 is a view showing frame tone (input into a liquid crystal unit), field tone, liquid crystal luminance and display in the case where the back light 901 is lighted continuously. When the frame tone is constant, a tone display is performed by being divided into two fields so that they should be in order of dark tone/light tone. A relation between the input tone into the liquid crystal unit=the frame tone and the luminance of the liquid crystal unit (hereinafter referred to as "$\gamma$ setting of a display section" is set to $\gamma$=2.4, and a relation between the frame tone and the respective field tones is set as shown in FIG. 10. The 8-bit frame tone is converted into an 8-bit tone of the first field (field on the lower luminance side) FD 1 and an 8-bit tone of the second field (fired on the higher luminance side) FD2. The time proportion of the first field FD1 and the second field FD2 is 1:1. A region 1003 is a region in which the tone of the second field FD2 is saturated.

Figure 8:
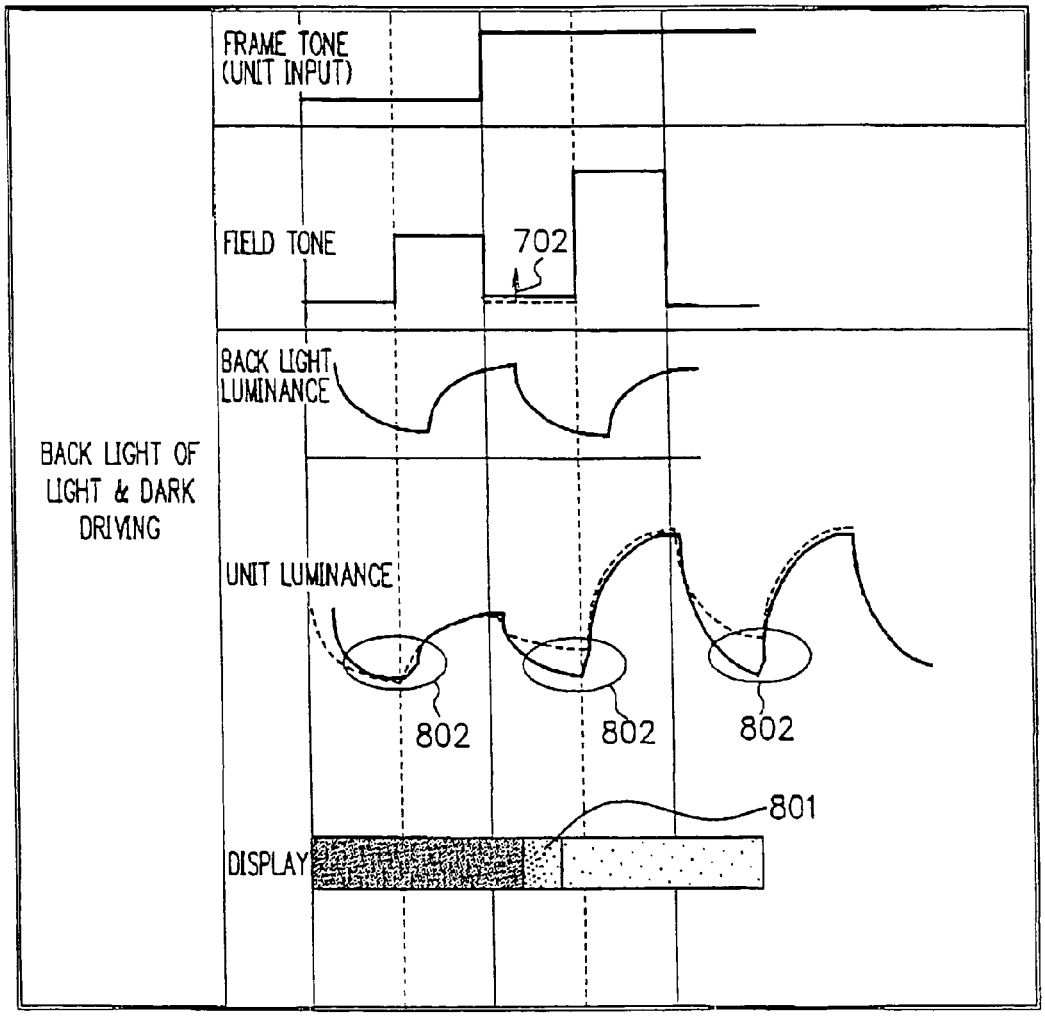
FIG. 8 is a view showing a back-light luminance, the liquid crystal unit luminance and display in the case where the back light is driven to/from light and dark.

FIG. 8 corresponds to FIG. 7 and is a view showing the frame tone (input into the liquid crystal), the field tone, the liquid crystal luminance and the display in the case where the back light 901 is driven to/from light and dark. As shown in FIGS. 9A and 9B, the back light 901 is divided into four portions in the vertical direction of the screen, in which a light/dark state at a duty ratio of 40% is repeatedly lighted at the same frequency as of the frame frequency. The setting as to the back light is as shown below.

fluorescent tube: a cold-cathode tube of an outer diameter of $\phi$3.0 mm and an inside diameter of $\phi$2.4 mm.

tube current: a light state 7 mA, a dark state 3.5 mA (instantaneous luminance ratio: light state 5:dark state 2)

For synchronizing the driving of the back light 901 with the driving of the liquid crystal panel 902, the following method is adopted. Around the time period of the writing performed into the gate line and assumed by the gate driver 102, a binary constant voltage signal (3.5 V/0 (zero) V) is sent to the driving portion of the back light 901 at the timings shown in the drawing. The driving portion of the back light can be light at a phase being independent in each block of the back light 901, and is placed under the control of the previously-described constant voltage signal to light. It is set to turn OFF at a signal voltage of 3 V or more and to turn ON at a signal voltage of 0.5 V or below.

When the frame tone has a change, a compensation value 702 is set to the first field FD1 so that the finally achieved luminance of the first field FD1 comes to the luminance of the first field FD1 of which frame tone is stabilized after the change to thereby activate overdrive. The compensation value is as shown in FIG. 10. With only this response compensation function, the time change of panel transmissivity becomes as shown in FIG. 7, in which a gradation of blur can be viewed in a period of a half (½) frame 701 from the moment that the frame tone changes.

Backed by the above-described configuration of the back-light drive circuit, between the light/dark driving of the back light, the panel driving shifts by a half (½) cycle at a center of each block with respect to the panel driving. Therefore, around the moment where the second field FD2 ends, the back light emits light while it is in the light state, and as a result, the unit luminance changes as shown in FIG. 8. After the frame tone change, a luminance waveform 802 of the first field FD1 becomes substantially the same as of the latest luminance (light amount) waveform, so that a clear contour appears. The display in an intermediate state appears only in a period 801 being shorter than the half (½) of the period 701.

As described above, the back light 901 increases/decreases luminance at the same frequency as the frame frequency. The back light 901 is divided into plural blocks in a line direction (in the direction toward which a line extends). In each block, for a pixel at the center portion of each block, the back light becomes the light state in a period around the end time of the second field FD2 having the highest tone out of the plural divided fields. The pixel at the center portion has a delay of a phase 201 as shown in FIGS. 2 to 4.

When a single frame is divided into two fields, between a tone I1 of the previous first field FD1 and a tone I2 of the following field, a relation of I2>=I1 is established all the time.

Figure 11:
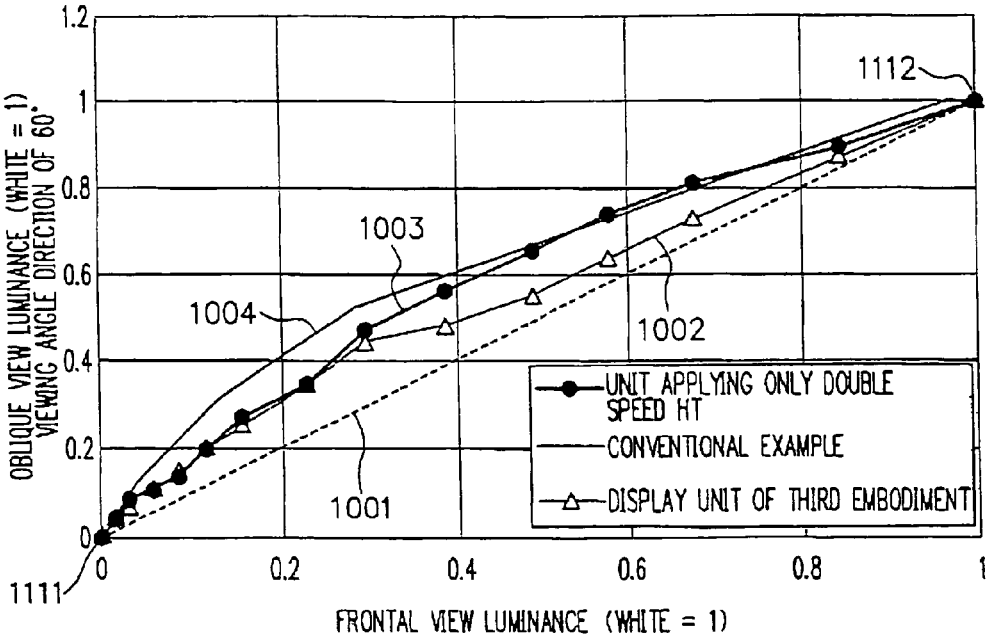
FIG. 11 is a view showing a relation between luminance of a frontal view and the luminance of an oblique view.

Incidentally, as a merit of placing the fields in the order of a dark field/light field in the single frame, a wider tone range applicable to the response compensation can be cited. FIG. 11 shows: an ideal state being a luminance rising state of 0 (zero) by a characteristic line 1001; a display unit according to the present embodiment by a characteristic line 1002; a display unit driven only at a double speed in which a single frame is divided into two fields by a characteristic line 1003; and a display unit with no field division by a characteristic line 1004. The horizontal axis shows luminance of a frontal view and the vertical axis shows luminance of an oblique view. In the case where it is in the order of the light field/dark field, no room is allowed to overdrive at a tone lighter than the halftone of the high tone (when the time proportion of the field division is 1:1, around 200 tone, and when the time proportion is 1:2, around 128 tone, both on the basis of 8-bit expression); meanwhile, in the case where it is in the order of the dark field/light field, the response compensation can be performed other than the case where a change is made to the tone of completely black or completely white. A completely black 1111 and a completely white 1112 have no effect in principle. The characteristic line 1002 according to the present embodiment comes close to the ideal characteristic line 1001, allowing a black floating caused when viewing obliquely to be eliminated, so that an oblique-view characteristic can be improved.

Fourth Embodiment

Figure 12A:
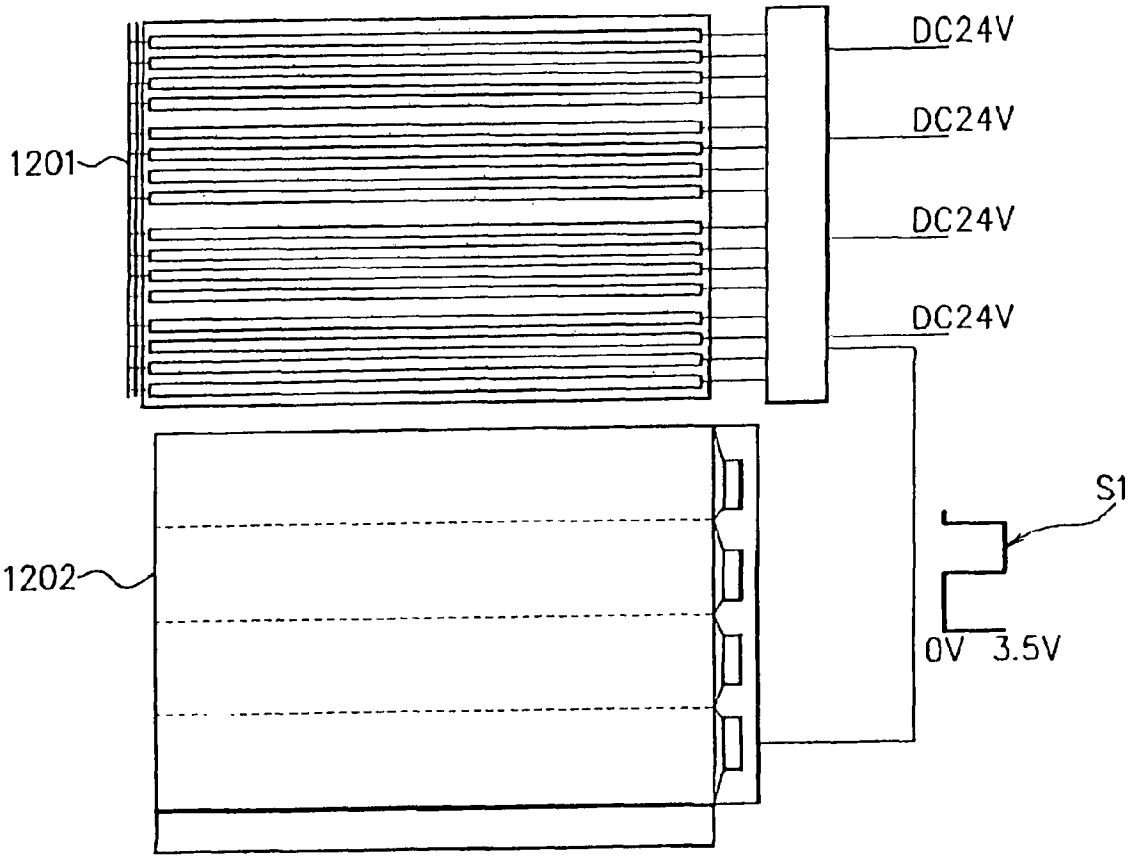
FIG. 12A is a view showing the connection example of the back light and the liquid crystal panel according to a fourth embodiment of the present invention.
Figure 12B:
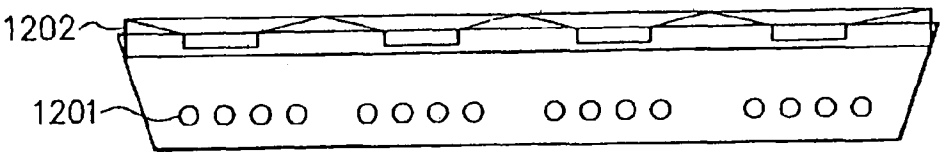
FIG. 12B is a sectional view of the back light and the liquid crystal panel.

FIG. 12A is a view showing a connection example of a back light 1201 and a liquid crystal panel 1202 according to a fourth embodiment of the present invention, and FIG. 12B is a sectional view of the back light 1201 and the liquid crystal panel 1202. The back light 1201 emits light to the liquid crystal panel 1202. The liquid crystal panel 1202 controls transmissivity of the light of the back light 1201 to carry out the tone expression.

The present embodiment shown in FIGS. 12A and 12B is that improves the moving-image display with a configuration being simpler than that of the third embodiment shown in FIGS. 9A and 9B. The back light 1201 is a back light of a direct-underlying type in which the entire screen is defined as a single section.

Figure 13:
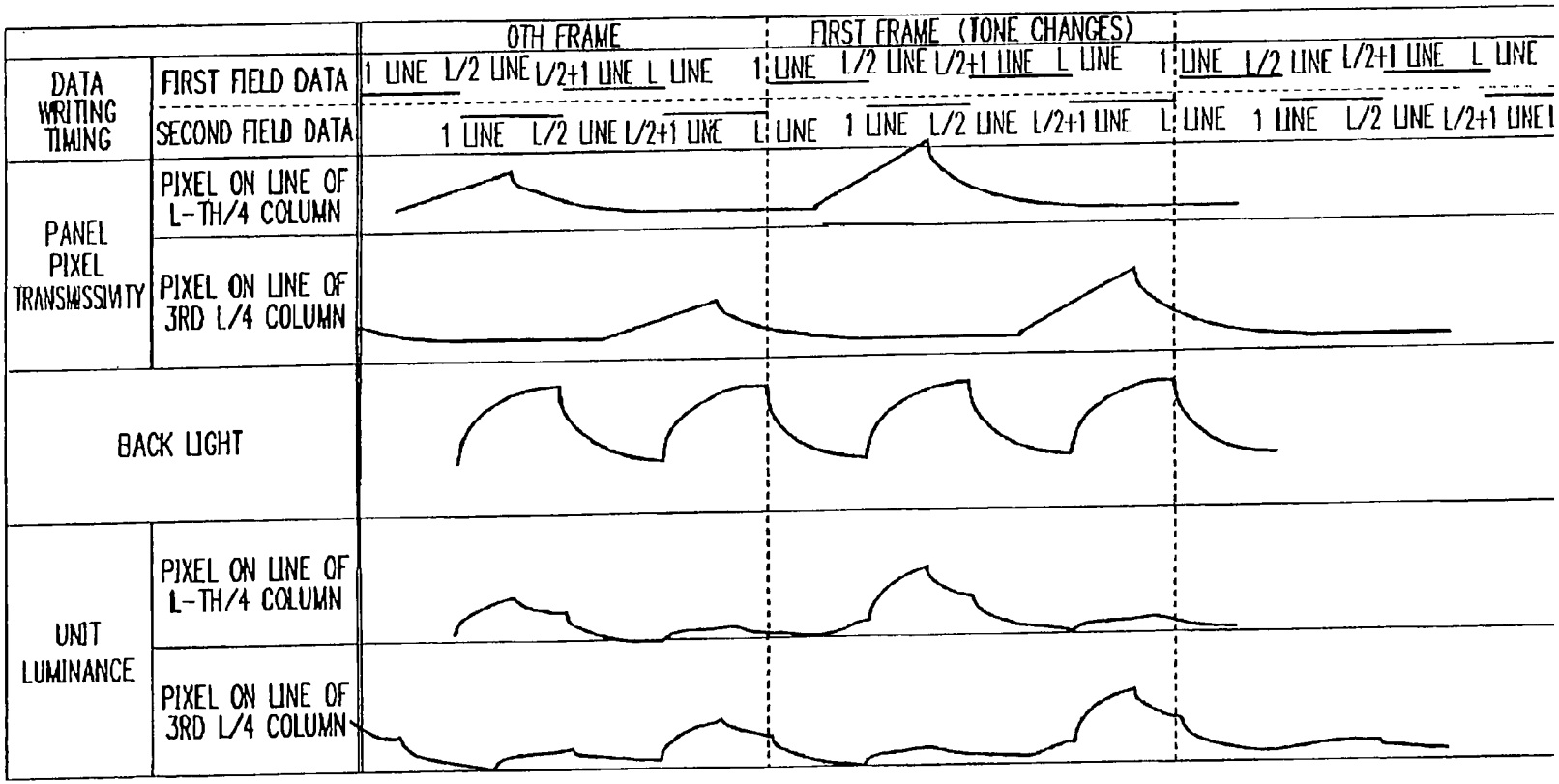
FIG. 13 is a timing chart showing a signal timing and a driving of the panel and the back light.

FIG. 13 is a timing chart showing a signal timing and a driving of the panel and the back light. The light/dark state at a duty ratio of 50% is repeatedly lighted at the same frequency as of the frame frequency. The setting as to the back light 1201 is as shown below.

fluorescent tube: a cold-cathode tube of an outer diameter of ϕ3.0 mm and an inside diameter of 2.4 mm.

tube current: a light state 7 mA, a dark state 3.5 mA (instantaneous luminance ratio: light state 5:dark state 2)

Around the time period of the writing performed into the gate line and assumed by the gate driver 102, a binary constant voltage signal (3.5 V/0 (zero) V) S1 is sent to the driving portion of the back light 1201 at the timing shown in the drawing. The back-light driving portion is controlled to light by the constant voltage signal S1. It is set to turn OFF at a signal voltage of 3 V or more, and turn ON at a signal voltage of 0.5 V or below.

The first and second fields have the first to the L-th lines, respectively, in which respective data writing timings are shown in FIG. 13. The transmissivity of the pixel of the panel is shown as to a pixel on a line of the L-th line/fourth column and a pixel on a line of the third line/fourth column. Also, the unit luminance is shown as to the pixel on the line of the L-th/fourth column and the pixel on the line of the third line/fourth column, corresponding thereto. The present embodiment can obtain the same effect as of the third embodiment as well.

As described above, according to the first and second embodiments, in the technology that divides a single frame time into plural fields and utilizes converted data with respect to data voltage of every field, it is possible to improve the fineness in the gray tone and the moving-image characteristic by adding the appropriate and minimum drive circuit technology thereto. Further, according to the third and fourth embodiments, by interlocking with the flashes of the back light, the degradation in the viewing-angle characteristic (luminance floating in the halftone, color shift) can be reduced.

According to the first and second embodiments, it is possible to prevent resolution insufficiency in the halftone display. Further, according to the third and fourth embodiments, the response compensation in the case where the frame tone data changes is enabled, so that a ghost image can be prevented especially in the luminance change between low tones.

Further, the display method of the halftone-driving method and the display method of displaying a constant tone for each frame (normal driving method) can be used appropriately by settings. At that time, a setting of tone-applied voltage is different between the halftone driving method and the normal driving method.

The resolution insufficiency in the halftone display can be prevented by dividing the single frame into the plural fields and performing correction to the field data when the tone change arises in the frame data.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A liquid crystal display device comprising:

a liquid crystal panel including plural gate lines to select a pixel and plural data lines to supply pixel data, and a data driver dividing a single frame into plural fields and converting frame data into field data to supply the field data to the data line, wherein of the plural fields, a field on a higher luminance side is shorter than the other field(s) in terms of time, and the single frame is divided into two fields and when a frame time is defined as T, the time of the field on the higher luminance side is defined as L, a response time from 10% to 90% of a finally achieved luminance when a change is made from a black display to a white display is defined as $\tau 1$, and a response time from 10% to 90% of a finally achieved luminance when a change is made from the white display to the black display is defined as $\tau 2$, a time proportion of the fields is set to meet an inequality shown below:

$$0.15\times T<L^2/(2.5\times\tau 1)+\tau 2/(2\times\tau 1)\times L<0.25\times T.$$

* * * * *